US009410345B2

(12) United States Patent
Uehara et al.

(10) Patent No.: US 9,410,345 B2
(45) Date of Patent: Aug. 9, 2016

(54) VEHICLE DOOR LOCK DEVICE

(75) Inventors: Hiroki Uehara, Nagoya (JP); Hiroshi Kawai, Nagoya (JP)

(73) Assignee: ANSEI CORPORATION, Obu-shi (JP)

( * ) Notice: Subject to any disclaimer, the term of this patent is extended or adjusted under 35 U.S.C. 154(b) by 364 days.

(21) Appl. No.: 13/985,995

(22) PCT Filed: Mar. 16, 2011

(86) PCT No.: PCT/JP2011/056188

§ 371 (c)(1),
(2), (4) Date: Aug. 16, 2013

(87) PCT Pub. No.: WO2012/124069

PCT Pub. Date: Sep. 20, 2012

(65) Prior Publication Data

US 2013/0328325 A1 Dec. 12, 2013

(51) Int. Cl.

| | |
|---|---|
| ***E05C 3/06*** | (2006.01) |
| ***E05B 77/06*** | (2014.01) |
| ***E05B 77/04*** | (2014.01) |
| ***E05B 77/00*** | (2014.01) |

(Continued)

(52) U.S. Cl.

CPC ..... *E05B 77/06* (2013.01); *E05B 77/00* (2013.01); *E05B 77/02* (2013.01); *E05B 77/04* (2013.01); *Y10T 292/0949* (2015.04)

(58) Field of Classification Search

CPC ..... E05B 77/00; E05B 77/02; E05B 77/04; E05B 77/06; Y10S 292/22

USPC ..... 292/216

See application file for complete search history.

(56) References Cited

U.S. PATENT DOCUMENTS

| | | | |
|---|---|---|---|
| 2,864,641 | A | 12/1958 | Leslie |
| 3,799,596 | A | 3/1974 | Nozomu et al. |
| 4,536,021 | A | 8/1985 | Mochida |

(Continued)

FOREIGN PATENT DOCUMENTS

| | | | |
|---|---|---|---|
| CN | 1122870 | 5/1996 | |
| DE | 1678024 B1 * | 8/1971 | ..... E05B 77/06 |

(Continued)

OTHER PUBLICATIONS

English translation of International Preliminary Examination Report from parent application No. PCT/JP2011/056188.

(Continued)

*Primary Examiner* — Carlos Lugo

(74) *Attorney, Agent, or Firm* — J-Tek Law PLLC; Jeffrey D. Tekanic; Scott T. Wakeman

(57) ABSTRACT

A switching mechanism of vehicle door lock device includes a pivotable first lever and a second lever that pivotably acts on a pawl. An inertial lever is provided on the first lever and is pivotable about an axis (X3) from an initial position when an inertial force is applied thereto. A transmitting portion is provided on the second lever and transmits the pivotal movement of the first lever to the second lever when the inertial lever is disposed in its initial position. In contrast, the transmitting portion does not transmit the pivotal movement of the first lever to the second lever when the inertial lever has been pivoted away from its initial position. A first axial center of pivotal movement of the first lever and a second axial center of pivotal movement of the second lever are coaxial axial centers of pivotal movement (X1).

20 Claims, 10 Drawing Sheets

(51) Int. Cl.
*E05B 77/02* (2014.01)
*E05C 3/16* (2006.01)

(56) References Cited

U.S. PATENT DOCUMENTS

| | | | | |
|---|---|---|---|---|
| 5,769,471 | A | 6/1998 | Suzuki et al. | |
| 5,865,481 | A | 2/1999 | Buschmann | |
| 6,698,262 | B2 | 3/2004 | Wittwer | |
| 8,056,944 | B2 * | 11/2011 | Jankowski | E05B 77/06 292/201 |
| 9,151,090 | B2 * | 10/2015 | Beck | E05B 77/06 |
| 2003/0234544 | A1 | 12/2003 | Jankowski et al. | |
| 2004/0245786 | A1 | 12/2004 | Hashiba et al. | |
| 2006/0131892 | A1 * | 6/2006 | Pereverzev | E05B 77/06 292/216 |
| 2007/0085349 | A1 | 4/2007 | Merideth et al. | |
| 2009/0079208 | A1 | 3/2009 | Mizuno et al. | |
| 2012/0110920 | A1 | 5/2012 | Takagi et al. | |
| 2014/0312630 | A1 * | 10/2014 | Bendel | E05B 77/06 292/195 |
| 2014/0346786 | A1 * | 11/2014 | Takagi | E05B 77/06 292/200 |

FOREIGN PATENT DOCUMENTS

| | | | | |
|---|---|---|---|---|
| DE | 19511651 | A1 * | 10/1995 | E05B 77/06 |
| DE | 19738492 | A1 * | 3/1998 | E05B 77/06 |
| DE | 10114965 | A1 * | 10/2002 | E05B 77/06 |
| DE | WO 2012055387 | A2 * | 5/2012 | E05B 77/06 |
| EP | 1 375 794 | | 1/2004 | |
| JP | 2005-120764 | | 5/2005 | |
| JP | 2005146746 | | 6/2005 | |
| JP | 2009-084994 | | 4/2009 | |
| JP | 2011-026780 | | 2/2011 | |
| WO | 2011/010554 | | 1/2011 | |

OTHER PUBLICATIONS

International Search Report from parent application No. PCT/JP2011/056188.

* cited by examiner

VEHICLE DOOR LOCK DEVICE

CROSS-REFERENCE

This application is the US national stage of International Patent Application No. PCT/JP2011/056188 filed on Mar. 16, 2011.

TECHNICAL FIELD

The present invention relates to a vehicle door lock device.

BACKGROUND ART

A prior-art vehicle door lock device is disclosed in Patent Document 1. The vehicle door lock device includes amounting member, a fork, a pawl, and a switching mechanism.

The mounting member is provided on a door that opens and closes an opening of a vehicle body. A striker is fixed to the vehicle body, and an entry opening that the striker enters is formed in the mounting member. The fork is pivotably provided on the mounting member. The fork is switched between a latched state, in which the striker is locked in the entry opening, and an unlatched state, in which the locking of the striker in the entry opening is released. The pawl is pivotably provided on the mounting member. The pawl is capable of fixing or allowing pivotal movement of the fork.

The switching mechanism acts on the pawl to switch the fork from the latched state to the unlatched state. More specifically, the switching mechanism includes an outside lever, which is pivotably supported by the mounting member, and an intermediate lever, which is pivotably supported at one end of the outside lever. The other end of the outside lever is coupled to an outside handle for a door-opening operation via a cable. When the other end of the outside lever is pulled upward by the door-opening operation, the one end of the outside lever and the intermediate lever are moved downward.

An engaging projection that projects downward and an engaging hole, which surrounds the engaging projection from below in a U-shape, are formed at a center of the intermediate lever. Two coil springs that face each other are provided between the intermediate lever and the mounting member. The intermediate lever is held at an initial position by the respective coil springs, and assumes a substantially vertically upright posture.

The pawl includes a ratchet abutting the fork, a rotation shaft having one of its ends integrally coupled to the ratchet, and an opening lever formed with an engaging claw portion that is integrally coupled to the other end of the rotation shaft. The engaging claw portion of the open lever is inserted into the engaging hole of the intermediate lever, and is positioned below the engaging projection.

In the prior-art vehicle door lock device having the above-described structure, when the intermediate lever is moved downward by the door-opening operation in a normal state, the engaging projection of the intermediate lever at the initial position presses the engaging claw portion of the opening lever. Therefore, the pawl pivots about the rotating shaft, the ratchet moves away from the fork, and the fork is switched from the latched state to the unlatched state.

Furthermore, in this vehicle door lock device, if the door or the vehicle body experiences an impact from the outside of the vehicle due to a collision or the like towards the vehicle, an inertia force will act on the intermediate lever in the direction of impact. Therefore, because the intermediate lever pivots from the initial position in the direction opposite to the direction of impact, the engaging projection is not positioned above the engaging claw portion. In addition, in this state, an opening operation of the door occurs due to the impact, and what results is a "swing-and-miss state", in which even if the intermediate lever moves downward, the engaging claw portion is not pressed by the engaging projection, i.e. the fork is not switched from the latched state to the unlatched state. In this manner, the prior-art vehicle door lock device prevents an unintended opening of the door at the time of impact, to ensure the safety of the passenger(s).

CITATION LIST

Patent Literature

Patent Document 1: JP-A-2005-120764

SUMMARY OF THE INVENTION

However, in the above-described prior-art vehicle door lock device, an improvement of the design flexibility relating to a relative positional relationship between the switching mechanism and the pawl is difficult, as will be described below as detailed examples; accordingly, a reduction in size and an improvement of the mountability with respect to the vehicle are difficult.

For example, in order to cope with a variety of relative positional relationships such as the door, the opening, the striker, and the outside handle, a situation is considered that changes the positions of the opening lever and the engaging claw portion, which constitute the pawl, from the one end side to the other end side of the outside lever. In this situation, in order to cause the intermediate lever supported by the one end of the outside lever to press the engaging claw portion that has changed in position, it is necessary to elongate the intermediate lever until it reaches the engaging claw portion. Accordingly, the weight of the intermediate lever is excessively increased and it becomes difficult to set the inertia force for causing the intermediate lever to pivot from the initial position in accordance with an impact having a desired magnitude. Furthermore, in the above-described situation, if it is attempted to bring the intermediate lever closer to the engaging claw portion that is changed in position from the one end side to the other end side of the outside lever, the components will be concentrated at the other end side of the outside lever and hence an installation space of the intermediate lever will be difficult to ensure.

It is therefore an object of the present teachings to disclose a device that is capable of preventing a vehicle door from being unintentionally opened at the time of an impact in a manner that preferably realizes an improvement in design flexibility with regard to the relative positional relationship of a switching mechanism and a pawl.

In one aspect of the present teachings, a vehicle door lock device preferably includes:

a mounting member provided on a door that opens and closes an opening of a vehicle body and is formed with an entry opening, into which a striker fixed to the vehicle body is inserted;

a fork pivotably provided on the mounting member and that switches between a latched state, in which the striker is locked within the entry opening, and an unlatched state, in which the locking of the striker within the entry opening is released;

a pawl pivotably provided on the mounting member and capable of fixing or allowing pivotal movement of the fork; and a switching mechanism provided on the mounting member and that acts on the pawl to switch the fork from the latched state to the unlatched state, wherein the switching mechanism includes:

a first lever coupled to an outer door handle or an inner door handle and that is pivotable about a first axial center of pivotal movement by an opening operation of the outer door handle or the inner door handle;

a second lever that acts on the pawl by pivoting about a second axial center of pivotal movement;

an inertial lever provided on one of the first lever and the second lever, being pivotable about an axis extending in a direction orthogonal to the direction of advance and retraction with respect to the opening, and that pivots from an initial position about the axis by application of an inertia force exceeding a preset value; and a transmitting portion provided on the other one of the first lever and the second lever, that transmits the pivotal movement of the first lever to the second lever by abutting against the inertia lever when the inertial lever is at the initial position and, in contrast, that does not transmit the pivotal movement of the first lever to the second lever by not abutting against the inertial lever when the inertial lever has pivoted from the initial position, and the first axial center of pivotal movement and the second axial center of pivotal movement are coaxial axial centers of pivotal movement.

In the vehicle door lock device of this aspect of the present teachings, the switching mechanism includes the first lever, the second lever, the inertial lever, and the transmitting portion. In a normal state, the inertial lever is disposed in its initial position. Therefore, in the normal state, when the first lever pivots about the first axial center of pivotal movement in response to the opening operation of the outer door handle or the inner door handle, the inertial lever provided on one of the first lever and the second lever and the transmitting portion provided on the other one of the first lever and the second lever abut against each other. The pivotal movement of the first lever is transmitted to the second lever. Therefore, since the second lever acts on the pawl by pivoting about the second axial center of pivotal movement, the fork is switched from the latched state to the unlatched state.

In the vehicle door lock device, the inertial lever pivots from the initial position about the axis by application of the inertia force exceeding the preset value. In other words, when the door or the vehicle body receives the impact in the direction of advance and retraction with respect to the opening of the vehicle due to a collision or the like towards the vehicle, the inertia force acts on the inertial lever in the direction opposite to the direction of impact. Therefore, the inertial lever pivots from the initial position in the direction opposite to the direction of impact about the axis extending in the direction orthogonal to the direction of advance and retraction with respect to the opening. Therefore, even when the first lever is unintentionally displaced, what results is a "swing-and-miss state" in which the inertial lever and the transmitting portion do not abut against each other. Therefore, since the pivotal movement of the first lever is not transmitted to the second lever, the second lever avoids acting on the pawl, whereby the fork is not switched from the latched state to the unlatched state. Consequently, an unintentional opening of the door at the time of impact does not occur, and hence the safety of the passenger(s) can be ensured.

In addition, in this vehicle door lock device, the inertial lever and the transmitting portion transmit or block forces between the first lever and the second lever, which constitute the switching mechanism. In addition, the first axial center of pivotal movement of the first lever and the second axial center of pivotal movement of the second lever correspond to the coaxial axial centers of pivotal movement. Therefore, the positions and the lengths of the inertial lever and the transmitting portion are not changed irrespective of the direction of the position of the pawl with respect to the axial center of pivotal movement, and the second lever is allowed to act on the pawl by setting the direction of projection of a portion, which acts on the pawl of the second lever, arbitrarily within a range from 0° to 360° about the axial center of pivotal movement. Also, since the length of the inertial lever need not to be increased, the inertial lever is unlikely to become excessively heavy; consequently, setting of the inertia force for causing the inertial lever to pivot from the initial position in accordance with an impact having a desired magnitude is facilitated.

Therefore, such a vehicle door lock device is capable of preventing an unintentional opening of the door at the time of impact and, simultaneously, is capable of improving or increasing the design flexibility with respect to the relative positional relationship between the switching mechanism and the pawl. Accordingly, a reduction in size of the vehicle door lock device and an improvement of the mountability with respect to the vehicle may be realized.

The inertia force for causing the inertial lever to pivot from the initial position may be set by adjusting a balance between a mass member of the inertial lever and an urging force of a spring provided between one of the first lever and the second lever and the inertial lever. The corresponding inertia force may be set by adjusting the balance between the mass member of the inertial lever and a frictional force acting on the inertial lever about the axis.

Preferably, the first lever includes a first input portion coupled to the outer door handle or the inner door handle and a first output portion integrated with the first input portion with the axial center of pivotal movement interposed therebetween. Preferably, the second lever includes a second input portion and a second output portion integrated with the second input portion with the axial center of pivotal movement interposed therebetween, the second output portion acting on the pawl. In addition, the inertial lever is preferably provided on one of the first output portion and the second input portion. In addition, the transmitting portion is preferably provided on the other one of the first output portion and the second input portion. In this configuration, both of the first lever and the second lever are disposed with the axial center of pivotal movement interposed therebetween in a balanced manner. Therefore, even when an inertia force caused at the time of impact acts on the first lever and the second lever, it is possible to prevent a conversion of a portion of the inertia force into a rotational force which causes the first lever and the second lever to pivot about the axial center of pivotal movement; consequently, the opening of the door at the time of a collision may be reliably prevented.

Preferably, a movable mechanism is provided on the second output portion or on the pawl, the movable mechanism disabling the pawl by a locking operation which prevents the fork in the latched state from being switched to the unlatched state and, in contrast, enabling the pawl by an unlocking operation which allows the fork in the latched state to be switched to the unlatched state. In this configuration, a locking and unlocking mechanism can easily be provided at the periphery of the axial center of pivotal movement, so that a further reduction in size may be realized.

Preferably, the first lever and the second lever are urged towards their respective original positions by a single torsion coil spring provided coaxially with the axial center of pivotal movement. In this configuration, in comparison with an embodiment in which urging members are provided separately on the first lever and the second lever, the number of components may be reduced. Moreover, by arranging the torsion coil spring coaxially with the axial center of pivotal movement, the space occupied by the torsion coil spring may be reduced.

Preferably, the axial center of pivotal movement is also the axial center of a pivot shaft body that supports the first lever and the second lever and a projecting portion that projects from the pivot shaft body towards the outside of the vehicle opening. In this configuration, even when an outer panel of the door has been smashed, sufficient spaces can be preserved between the first lever, the second lever, the inertial lever, and the transmitting portion, and the smashed outer panel due to the projecting portion. Therefore, it is possible to reduce the probability of the occurrence of the problem in which pivotal movement of the inertial lever caused by the inertia force will be impaired or blocked by the smashed outer panel, whereby it is possible to reliably prevent the opening of the door at the time of a collision.

Preferably, by bending the first lever and the second lever into a crank shape toward an interior of the vehicle opening, the inertial lever and the transmitting portion are inclined toward the interior of the vehicle opening. In this configuration, even when the outer panel of the door has been smashed, sufficient space may be reliably preserved between the inertial lever and the transmitting portion, which are inclined toward the vehicle opening, and the smashed outer panel. Therefore, it is possible to further reduce the probability of the occurrence of the problem in which pivotal movement of the inertial lever caused by the inertia force will be impaired or blocked by the smashed outer panel, whereby it is possible to further reliably prevent the opening of the door at the time of a collision.

EMBODIMENTS FOR CARRYING OUT THE INVENTION

Figure 1:
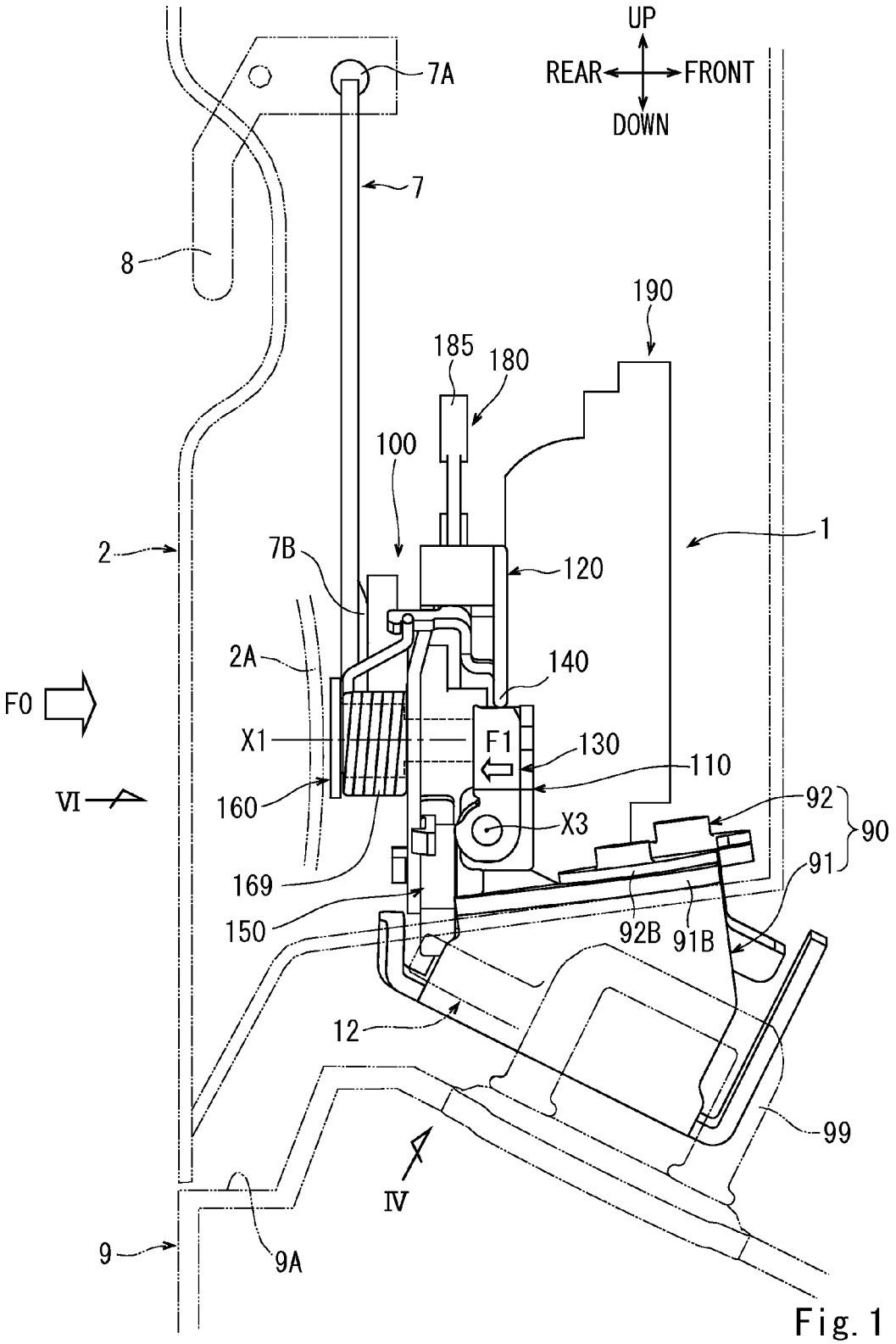
FIG. 1 is a side view of a vehicle door lock device of an example.

Referring now to the drawings, representative examples of the present teachings will be described below.

First Embodiment

As illustrated in FIG. 1, a vehicle door lock device 1 (hereinafter, simply referred to as "door lock device 1") of a first representative example may be utilized in a vehicle such as an automotive vehicle, a bus, or an industrial vehicle. The door lock device 1 is disposed on the lower end edge side of a tail gate 2 that opens and closes an opening 9A of a vehicle body 9. The tail gate 2 is an example of a door according to the present teachings. In the alternative, the door lock device 1 may be provided on a side door that opens and closes in a left and right direction with respect to the vehicle body 9.

In FIG. 1, only a lower end edge of the vehicle opening 9A is illustrated. The opening 9A widely opens in a substantially rectangular shape at a rear portion of the vehicle body 9 and enables an interior of the vehicle body 9 to communicate with the exterior in the fore-and-aft direction. In FIG. 1, the side of the paper plane corresponds to the front side of the vehicle, and the right left side of the paper plane corresponds to the rear side of the vehicle. In FIG. 1, the near side of the paper plane corresponds to the right side of the vehicle and the inner (opposite) side of the paper plane corresponds to the left side of the vehicle. In addition, the fore-and-aft direction, the vertical direction, and the left-and-right direction of the respective drawings from FIG. 2 onward are all indicated in the same manner that corresponds to FIG. 1.

Although an illustration is omitted, an upper end edge of the tail gate 2 is pivotably supported on the vehicle body 9 via a hinge. As illustrated in FIG. 1, in a state in which a lower end edge of the tail gate 2 hangs downward, the tail gate 2 closes the opening 9A. In addition, although an illustration is omitted, by pivoting the lower end edge of the tail gate 2 rearward and obliquely upward, the tail gate 2 opens the opening 9A. A substantially "U" shaped striker 99 is formed at the lower end edge of the opening 9A so as to project toward the lower end edge of the tail gate 2.

Figure 2:
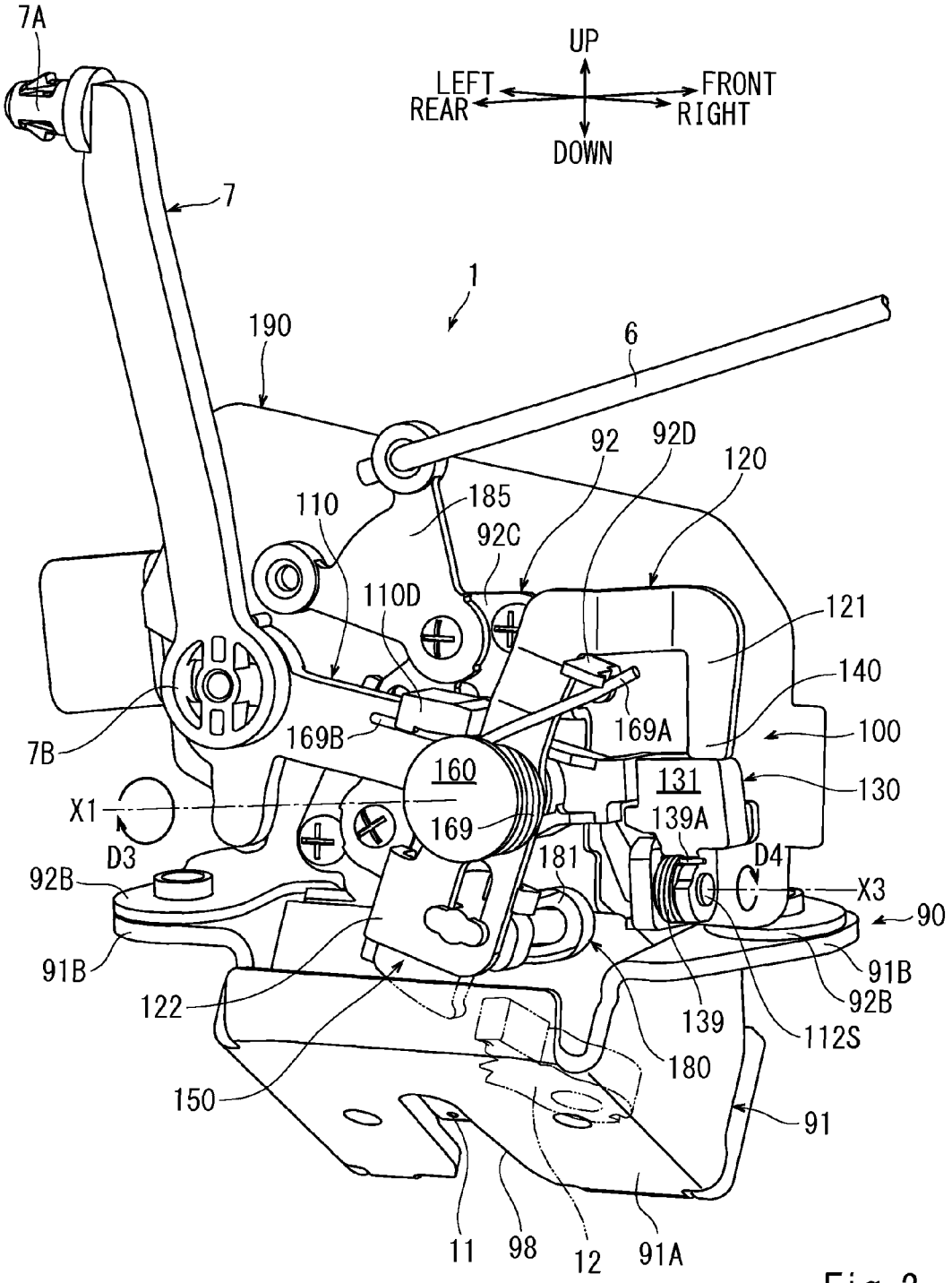
FIG. 2 is a perspective view of the vehicle door lock device of the example.
Figure 3:
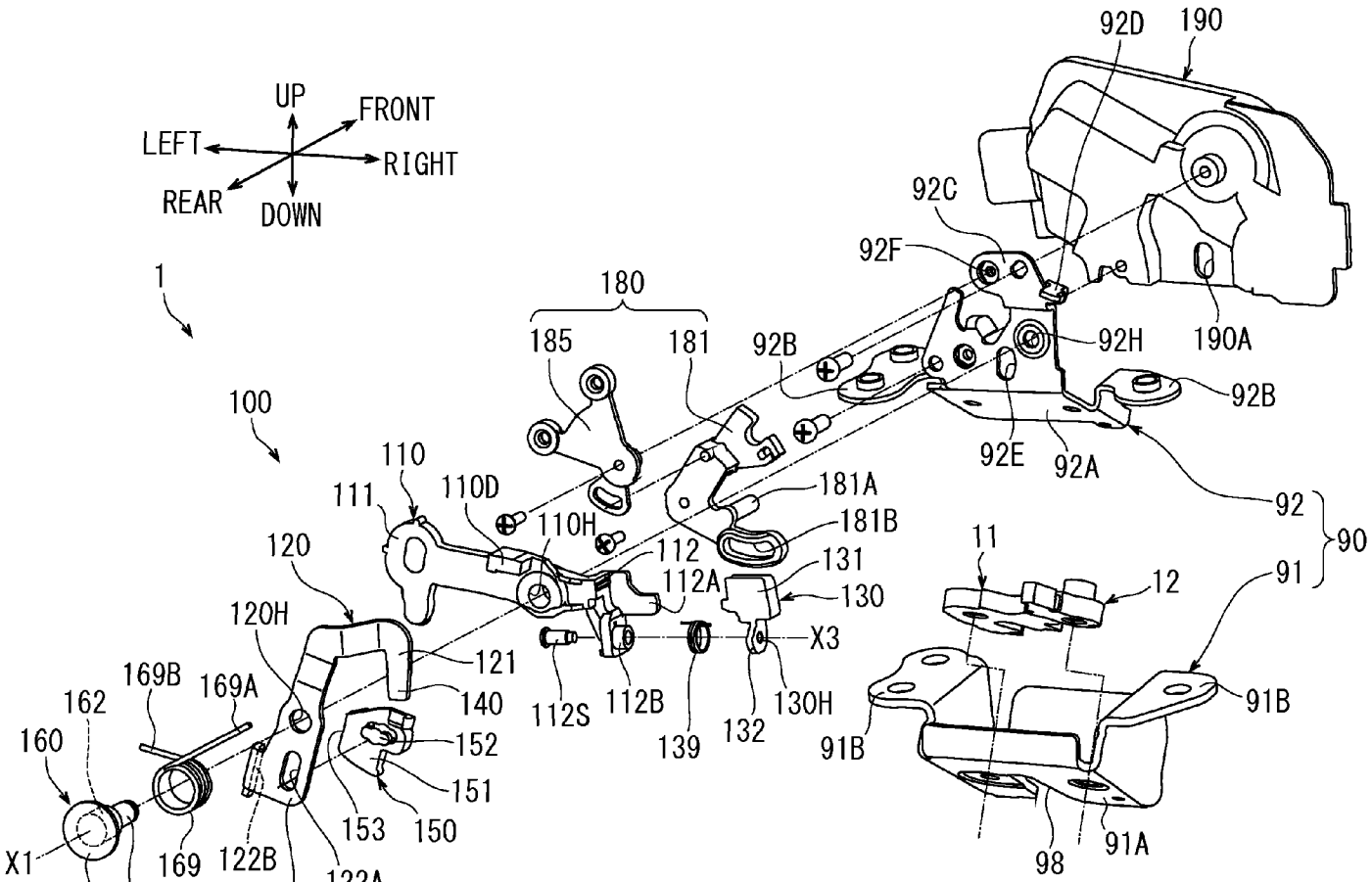
FIG. 3 is an exploded perspective view of the vehicle door lock device of the example.

As illustrated in FIG. 1 to FIG. 3, the door lock device 1 includes a mounting member 90, a fork 11, a pawl 12, a switching mechanism 100, a locking and unlocking mechanism 180, and an electric actuator 190.

As illustrated in FIG. 3, the mounting member 90 includes a mounting member body 91 and a back plate 92, which are bent steel plates respectively formed by press working.

Figure 4:
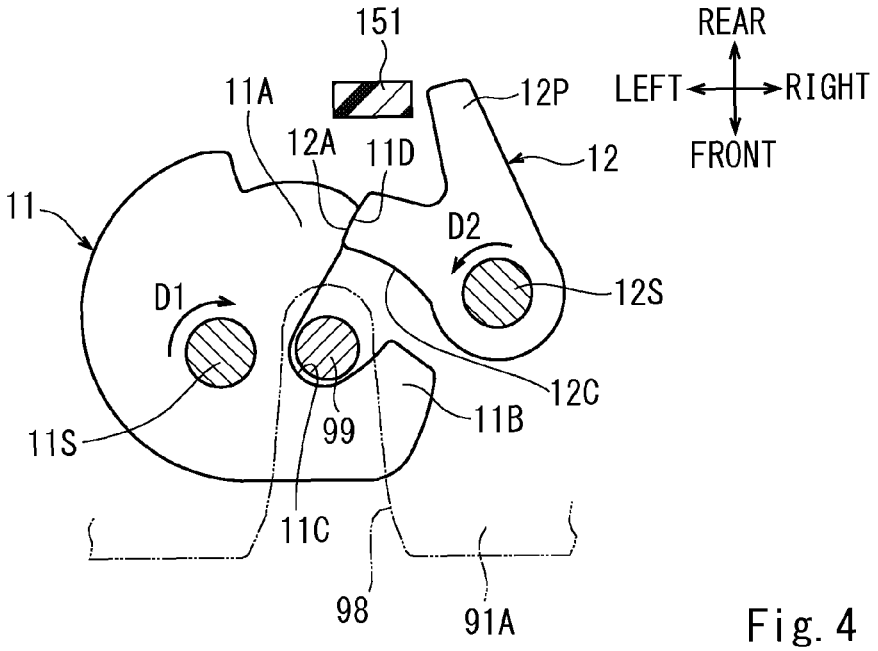
FIG. 4 relates to the vehicle door lock device of the example, and is a schematic drawing illustrating a fork and a pawl viewed in the direction of arrow IV in FIG. 1 (illustrating the fork in a latched state).

The mounting member body 91 includes a concave portion 91A that concaves downwardly and a pair of mounting portions 91B that extend substantially horizontally from both the left and right sides of the concave portion 91A. The concave portion 91A is formed with an entry opening 98 formed by being notched in a deep groove shape from the front of the vehicle towards the rear. When the door lock device 1 moves in association with the opening and closing of the tail gate 2, the striker 99 is adapted to relatively enter into the entry opening 98 as illustrated in FIG. 1 and FIG. 4. As illustrated in FIG. 3 and FIG. 4, the fork 11 and the pawl 12 are disposed on the left and right of the entry opening 98 in the concave portion 91A. In FIG. 4, the entry opening 98 is positioned on the near side in the paper plane with respect to the fork 11 and the pawl 12, and hence is illustrated by a double-dashed chain line. The same applies to FIG. 5.

As illustrated in FIG. 3, the back plate 92 includes a lid portion 92A having a substantially flat-plate shape, a pair of the left and right mounting portions 92B extending substantially horizontally from both the left and right sides of the lid portion 92A, and an upright wall portion 92C standing up substantially vertically from a rear end edge of the lid portion 92A. By assembling the back plate 92 onto the mounting member body 91 from above, the lid portion 92A covers the concave portion 91A, and the mounting portions 92B overlap the mounting portions 91B. The switching mechanism 100 and the locking and unlocking mechanism 180 are assembled onto the rear surface side of the upright wall portion 92C. The electric actuator 190 is assembled onto the front side of the upright wall portion 92C. In addition, as illustrated in FIG. 1, by fastening both of the mounting portions 91B, 92B onto an inner frame of the tail gate 2, the door lock device 1 is fixed to the lower end edge of the tail gate 2.

As illustrated in FIG. 4, the fork 11 is pivotably supported by the fork pivot shaft 11S disposed on the left side of the entry opening 98. In addition, the fork 11 is urged by a not-illustrated coil spring to pivot in the direction D1 about the fork pivot shaft 11S.

The fork 11 is formed with a rear side projection 11A and a front side projection 11B. In addition, the striker 99 inserted in the entry opening 98 is configured to be accommodated in a concave portion 11C formed between the rear side projection 11A and the front side projection 11B. In the state illustrated in FIG. 4, the fork 11 holds the striker 99 at a bottom portion of the entry opening 98. A latch surface 11D that is capable of abutting against a stopper surface 12A, which will be described later, is formed on the front end side of the rear side projection 11A, which front end side faces the pawl 12.

The pawl 12 is pivotably supported by a pawl pivot shaft 12S disposed on the right side of the entry opening 98. In addition, the pawl 12 is urged by a not-illustrated coil spring to pivot in the direction D2 about the pawl pivot shaft 12S. Normally, the posture illustrated in FIG. 4 is maintained.

The pawl 12 is formed with the stopper surface 12A. The stopper surface 12A is a curved surface curving in an arcuate shape about the pawl pivot shaft 12S, and is formed so as to face the latch surface 11D described above. An arc which constitutes the stopper surface 12A is discontinued on the side of the fork 11, and from that point, a sliding surface 12C extending on the pawl pivot shaft 12S side is formed.

The pawl 12 is formed with an abutting portion 12P adjacent to the stopper surface 12A. The abutting portion 12P projects so as to extend away from the pawl pivot shaft 12S towards the rear.

As illustrated in FIG. 4, in a state in which the fork 11 holds the striker 99 at the bottom portion of the entry opening 98, the stopper surface 12A of the pawl 12 abuts against the latch surface 11D of the rear side projection 11A. In this manner, the pawl 12 fixes the fork 11 so as to not allow the fork 11 to pivot in the direction D1. Accordingly, the fork 11 is brought into the latched state in which the tail gate 2 is locked.

Figure 5:
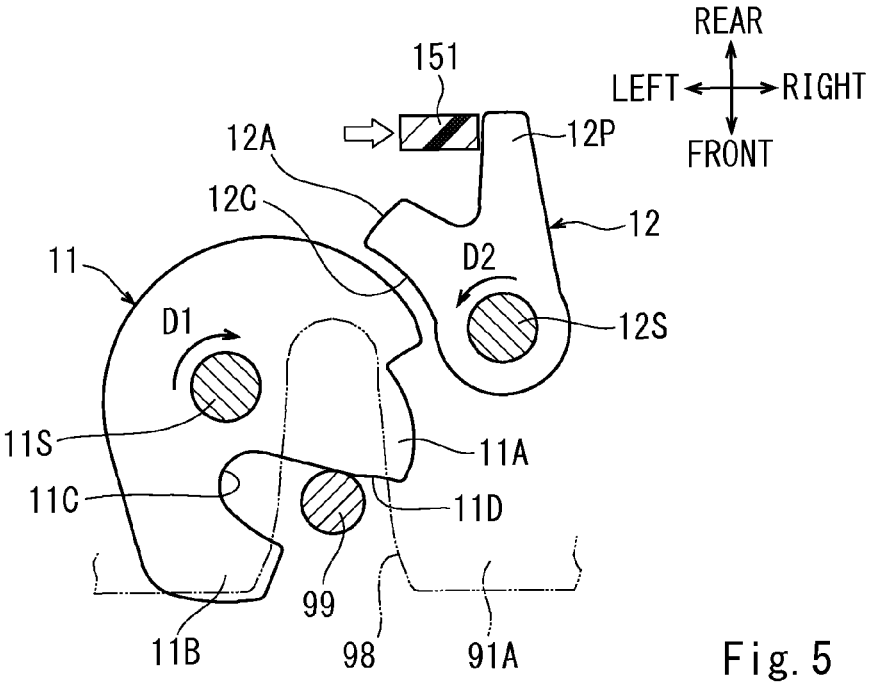
FIG. 5 relates to the vehicle door lock device of the example, and is a schematic drawing illustrating the fork and the pawl viewed in the direction of arrow IV in FIG. 1 (illustrating the fork in an unlatched state).
Figure 11:
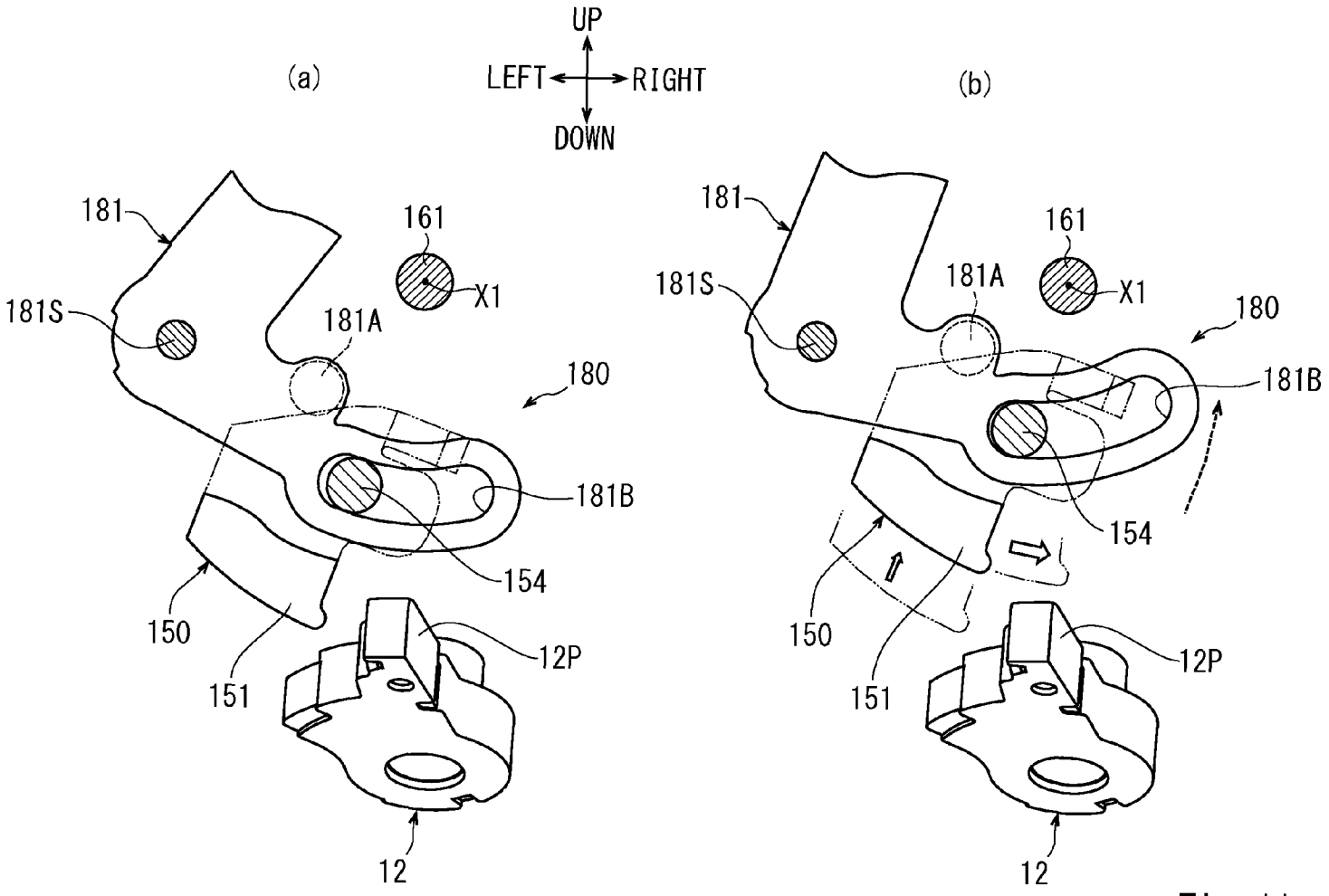
FIG. 11 relates to the vehicle door lock device of the example, in which (a) and (b) are rear views for explaining the operations of a movable mechanism and a locking and unlocking mechanism.

Then, when an operating portion 151 of a movable mechanism 150, which will be described later with reference to FIG. 11, is displaced rightward from the state illustrated in FIG. 4 and presses the abutting portion 12P as illustrated in FIG. 5, the pawl 12 pivots about the pawl pivot shaft 12S in the direction opposite to the direction D2 while opposing the urging force of the not-illustrated coil spring. In this case, since the stopper surface 12A moves away from the latch surface 11D, the pawl 12 releases the fork 11. Therefore, the fork 11 pivots about the fork pivotal shaft 11S in the direction D1 due to the urging force of the not-illustrated coil spring, and displaces the striker 99 in the direction away from the entry opening 98. As a result, the fork 11 is switched to the unlatched state in which the striker 99 is not locked in the entry opening 98. At this time, the tail gate 2 displaces from a completely closed state to a slightly opened state.

In contrast, when the striker 99 enters the entry opening 98, the fork 11 and the pawl 12 act in the order opposite to that described above. In other words, when the striker 99 in the state illustrated in FIG. 5 enters into the bottom portion of the entry opening 98 as illustrated in FIG. 4, the striker 99 presses the rear side projection 11A to pivot the fork 11 toward the original state. Accordingly, the stopper surface 12A pivots in the direction D2 due to the urging of the not-illustrated coil spring, and abuts against the latch surface 11D. Consequently, the fork 11 is returned to the latched state.

As illustrated in FIG. 1 and FIG. 2, the switching mechanism 100 includes a pivot shaft 160, a first lever 110, a second lever 120, an inertial lever 130, a transmitting portion 140, and the movable mechanism 150. These components are extracted and illustrated in FIG. 6 to FIG. 11.

Figure 7:
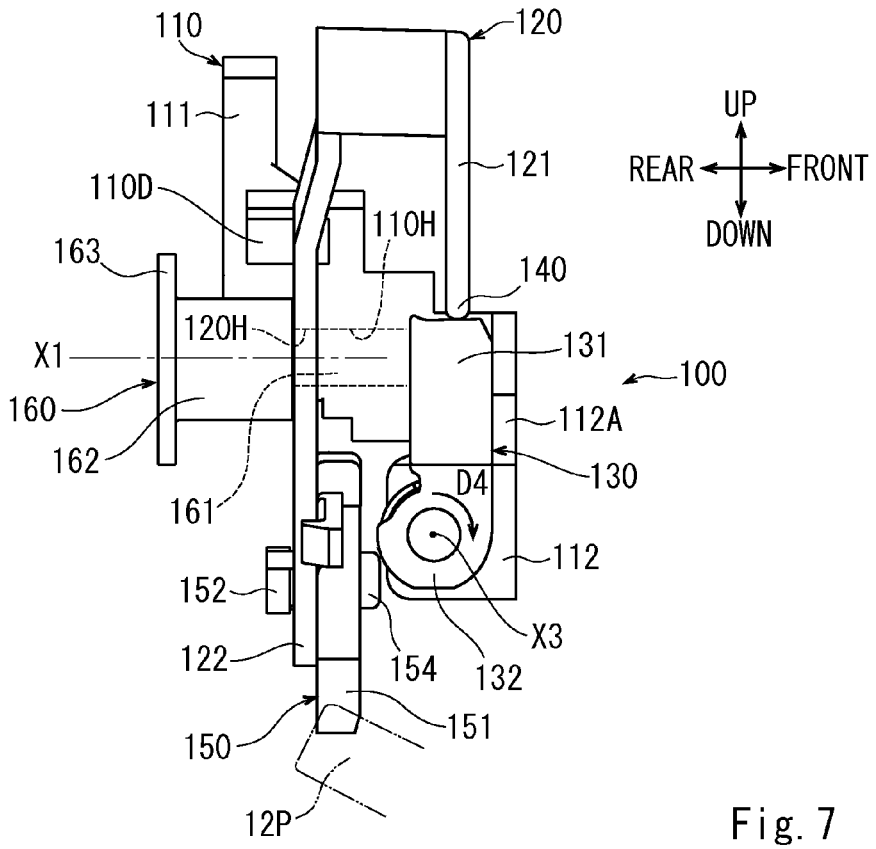
FIG. 7 relates to the vehicle door lock device of the example, and is a side view illustrating the first lever, the second lever, the inertial lever, and the transmitting portion viewed in the direction of arrow VII in FIG. 6.
Figure 8:
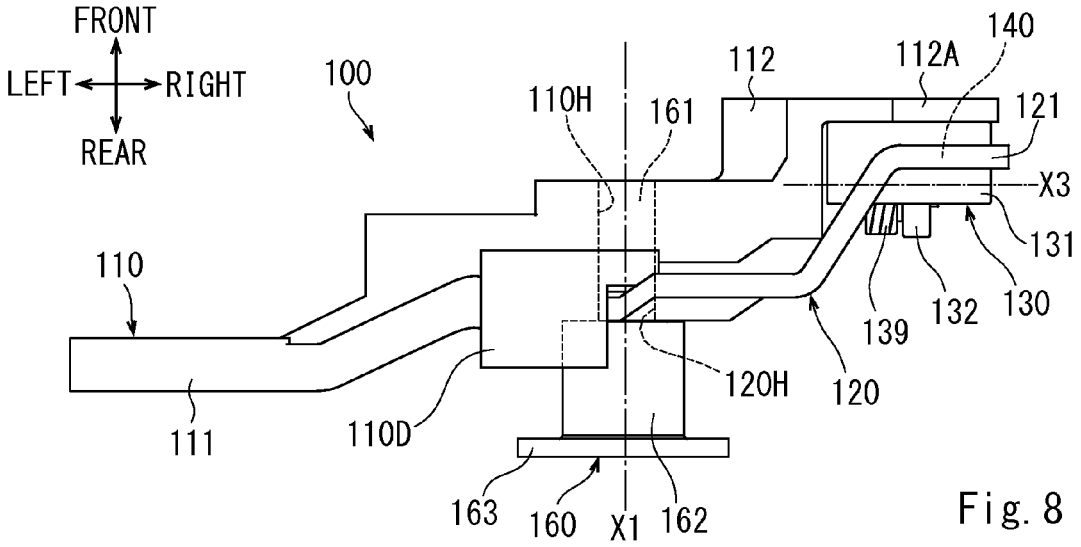
FIG. 8 relates to the vehicle door lock device of the example, and is a top view illustrating the first lever, the second lever, the inertial lever, and the transmitting portion viewed in the direction of arrow VIII in FIG. 6.

As illustrated in FIG. 3, FIG. 7, and FIG. 8, the pivot shaft 160 is a metallic shaft body composed of a pivot shaft body 161 formed into a column shape extending in the fore-and-aft direction, a projecting portion 162 that continues to a rear end of the pivot shaft body 161, and a flange portion 163 that continues to a rear end of the projecting portion 162 and has a thin disc shape with an outer diameter larger than that of the projecting portion 162.

As illustrated in FIG. 3, and FIGS. 6 to 8, the first lever 110 is an injection molded product formed of a thermoplastic resin, and is formed into a substantially plate shape extending longitudinally in the left and right direction. A shaft hole 110H is formed so as to penetrate through a center of the first lever 110 in the fore-and-aft direction. The second lever 120 is a metallic steel-plate member formed by sheet-metal pressing, and the second lever 120 is formed into an inverted "J" shape when viewed from the rear. A shaft hole 120H is formed so as to penetrate at a center of the second lever 120 in the fore-and-aft direction.

As illustrated in FIG. 1 to FIG. 3, a torsion coil spring 169 is mounted on the projecting portion 162. As illustrated in FIG. 3 and FIG. 7, the shaft hole 110H of the first lever 110 and the shaft hole 120H of the second lever 120 allow the pivot shaft body 161 to be inserted therethrough. At this time, the shaft hole 110H is positioned on the front side relative to the shaft hole 120H. Furthermore, as illustrated in FIG. 3, the front end of the pivot shaft body 161 is fitted into a shaft hole 92H formed so as to penetrate through the upright wall portion 92C. Accordingly, the pivot shaft 160 is fixed to the upright wall portion 92C. The first lever 110 and the second lever 120 are pivotably supported by the pivot shaft body 161. As illustrated in FIG. 1, when the door lock device 1 is fixed to the lower end edge of the tail gate 2, the projecting portion 162 is brought into a state of projecting from the pivot shaft body 161 outward (that is, rearward) of the opening 9A.

The center axis of the pivotal shaft 160 constitutes an axial center of pivotal movement X1. In other words, a first axial center of pivotal movement of the first lever 110 according to the present invention and a second axial center of pivotal movement of the second lever 120 according to the present invention correspond to the coaxial axial centers of pivotal movement X1.

As illustrated in FIG. 3, a rearward-projecting locking strip 92D is formed on an upper portion of the upright wall portion 92C. As illustrated in FIG. 2, one end 169A of the torsion coil spring 169 is hooked by the locking strip 92D. As illustrated in FIG. 3, a rearward-projecting prismatic column portion 110D is formed above the shaft hole 110H of the first lever 110. In addition, as illustrated in FIG. 2, the other end 169B of the torsion coil spring 169 is hooked on a lower surface of the prismatic column portion 110D.

Figure 6:
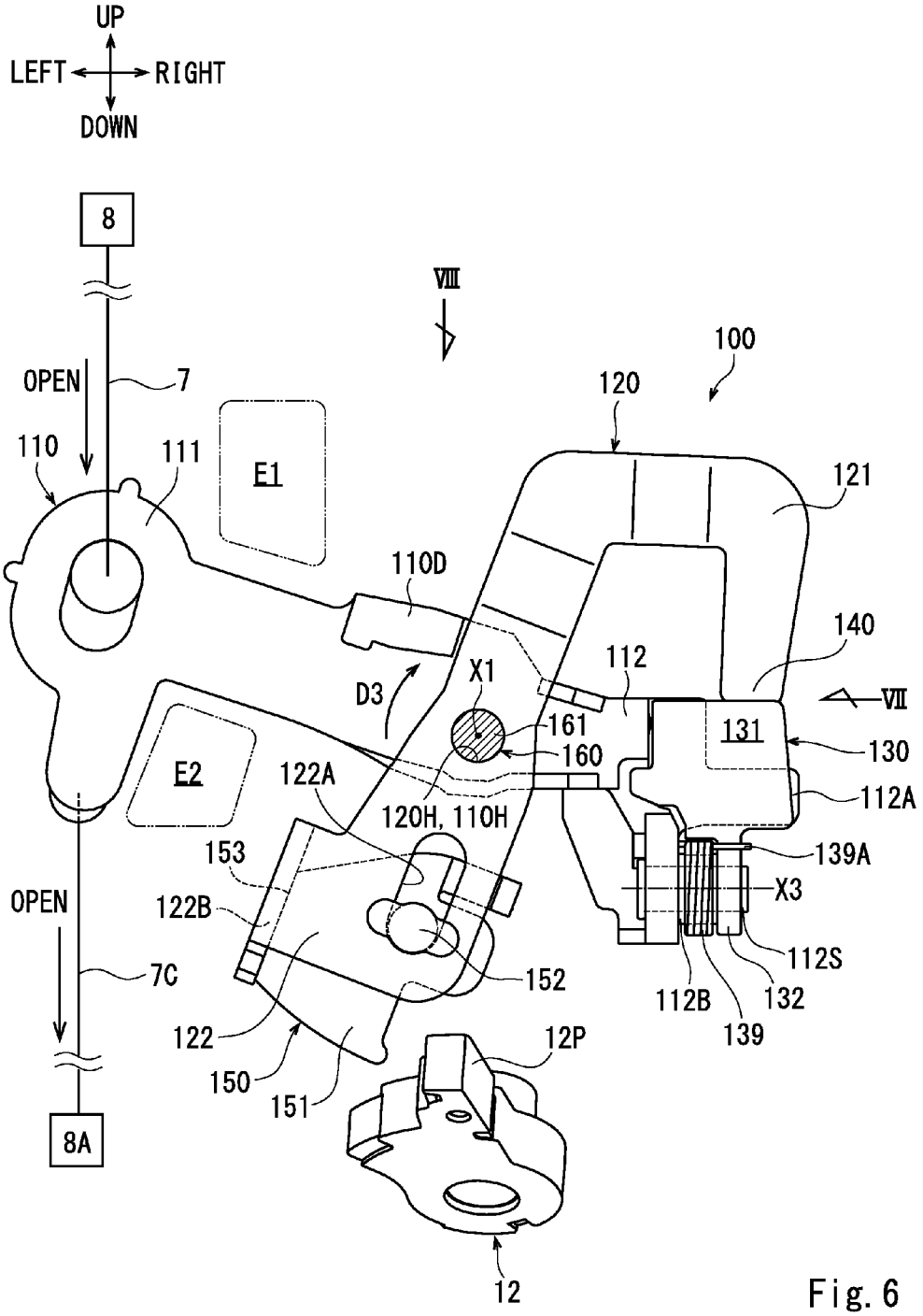
FIG. 6 relates to the vehicle door lock device of the example, and is a rear view illustrating a first lever, a second lever, an inertial lever, and a transmitting portion viewed in the direction of arrow VI in FIG. 1.

The first lever 110 is urged by the above-described torsion coil spring 169 in the direction D3 about the axial center of pivotal movement X1 as illustrated in FIG. 3 and FIG. 6. In addition, by abutting a right side surface of the prismatic column portion 110D against a left end edge of the second lever 120, the second lever 120 is also urged in the direction D3 about the axial center of pivotal movement X1. Furthermore, by abutting and stopping a right end edge of the second lever 120 against the locking strip 92D, the postures of the first lever 110 and the second lever 120 are determined when not in operation.

The first lever 110 and the second lever 120 when not in operation are extracted and illustrated in FIG. 6. FIG. 7 illustrates a side view as viewed from the direction indicated by arrow VII in FIG. 6, and FIG. 8 illustrates a top view as viewed from the direction indicated by arrow VIII in FIG. 6.

As illustrated in FIG. 6 to FIG. 8, the first lever 110 includes a first input portion 111 and a first output portion 112 which are formed integrally with the axial center of pivotal movement X1 interposed therebetween.

As illustrated in FIG. 6, the first input portion 111 extends leftward from the axial center of pivotal movement X1. As illustrated in FIG. 2, a lower end 7B of a rod 7 extending in the vertical direction in a rod shape is coupled to a left end of the first input portion 111.

Figure 9:
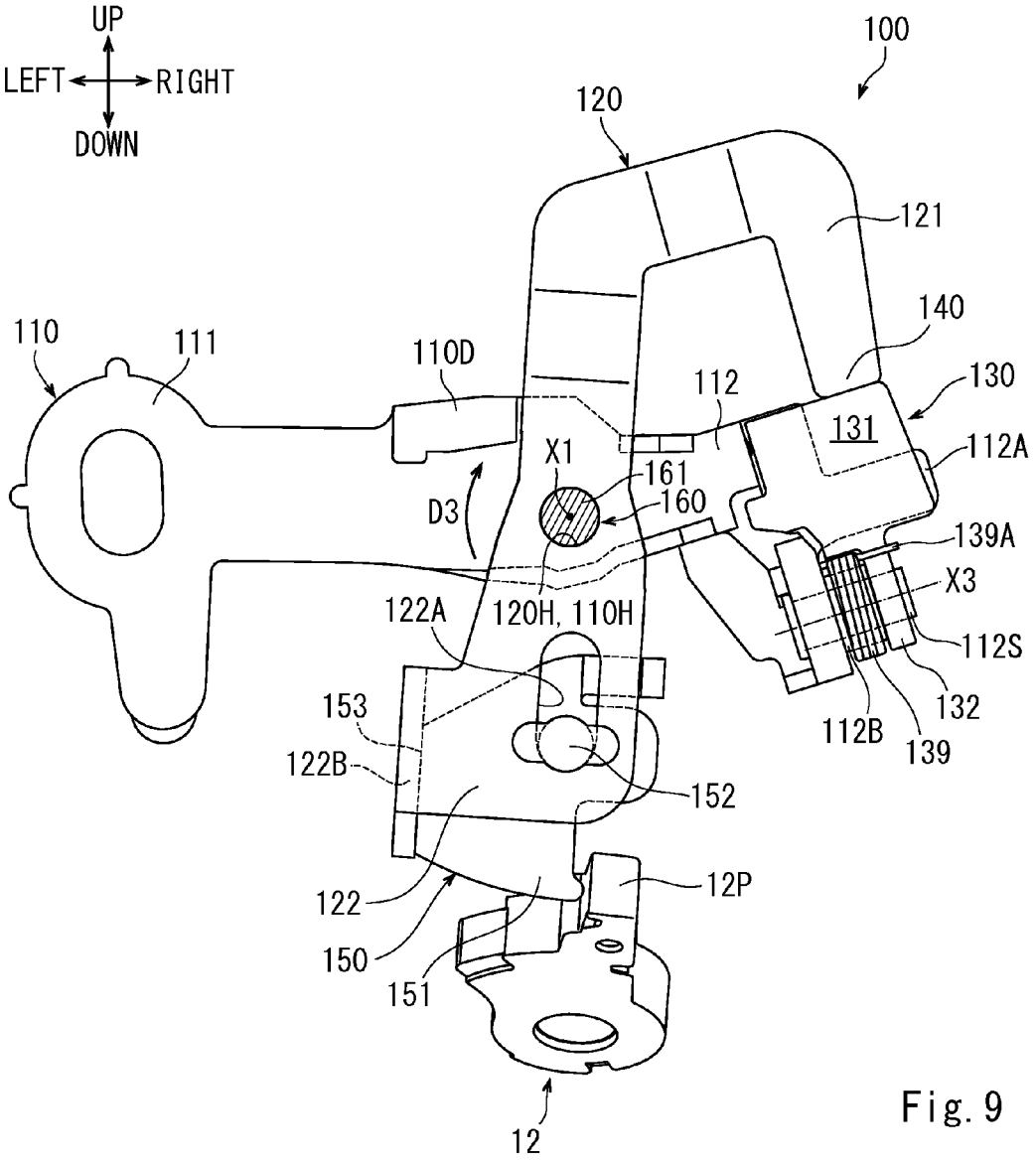
FIG. 9 relates to the vehicle door lock device of the example, and is a rear view illustrating the first lever, the second lever, the inertial lever, and the transmitting portion pivoted about an axial center of the pivotal movement from the state illustrated in FIG. 6.

As illustrated in FIG. 1 and in FIG. 6, an upper end 7A of the rod 7 is coupled to an outer door handle 8. As illustrated in FIG. 6, a second rod (unnumbered) couples the first input portion 11 to an inner door handle 8A via a cable, rod or wire 7C. When either the outer door handle 8 or the inner door handle 8A is operated by a passenger, the corresponding rod is displaced downward, and this downward displacement is transmitted to the left end of the first input portion 111. As a result, as illustrated in FIG. 9, the first lever 110 pivots about the axial center of pivotal movement X1 in the direction opposite to the direction D3 while opposing the urging force of the torsion coil spring 169. In addition, when neither the outer door handle 8 nor the inner door handle 8A is being operated (pulled) and hence the rods 7, 7C are displaced upward, the first lever 110 is restored to the original position by the urging force of the torsion coil spring 169.

As illustrated in FIG. 6, the first output portion 112 extends rightward from the axial center of pivotal movement X1. In the plan view as illustrated in FIG. 8, the first lever 110 is bent into a crank shape so that the first output portion 112 is positioned forward of the shaft hole 110H. By projecting the projecting portion 162 rearward, the first lever 110 is positioned forward of the flange portion 163.

As illustrated in FIG. 3 and FIG. 6 to FIG. 8, a supporting wall portion 112A projecting rightward in a substantially flat plate shape is formed on the first output portion 112. Also, as illustrated in FIG. 3 and FIG. 6, a boss portion 112B projecting rightward in a cylindrical shape is formed on the first output portion 112. The boss portion 112B is positioned below and rearward of the supporting wall portion 112A.

A torsion coil spring 139 is mounted on the outer peripheral side of the boss portion 112B. In contrast, an inertial lever pivot shaft 112S formed into a multi-step column shape is inserted into the boss portion 112B on the inner peripheral side. In addition, a right end portion of the inertial lever pivot shaft 112S projects rightward from the boss portion 112B.

As illustrated in FIG. 3, the inertial lever 130 includes a mass member 131, which is a die-cast product formed of a zinc alloy and having a substantially parallelepiped shape, and a supported portion 132 projecting downward from the mass member 131. The supported portion 132 is formed with a shaft hole 130H that penetrates therethrough in the left-and-right direction. By inserting the right end portion of the inertial lever pivot shaft 112S into the shaft hole 130H, the inertial lever 130 is pivotably supported about an axis X3, which is an axial center of the inertial lever pivot shaft 112S. The axis X3 extends in the direction orthogonal to the direction of advance and retraction (that is, the fore-and-aft direction) in the opening 9A (that is, the left and right direction).

As illustrated in FIG. 2 and FIG. 6, the torsion coil spring 139 extends coaxially with the axis X3. One end 139A of the torsion coil spring 139 is hooked on the inertial lever 130. Although an illustration is omitted, the other end of the torsion coil spring 139 is hooked on the first output portion 112. Accordingly, as illustrated in FIG. 2 and FIG. 7, the torsion coil spring 139 urges the inertial lever 130 in the direction D4 about the axis X3. In this manner, as illustrated in FIG. 1, FIG. 2, and FIG. 6 to FIG. 9, the inertial lever 130 takes a posture positioned right above the supported portion 132 in a normal state with the mass member 131 abutting against and stopping on the supporting wall portion 112A. This position of the inertial lever 130 is an initial position of the present invention.

Figure 10:
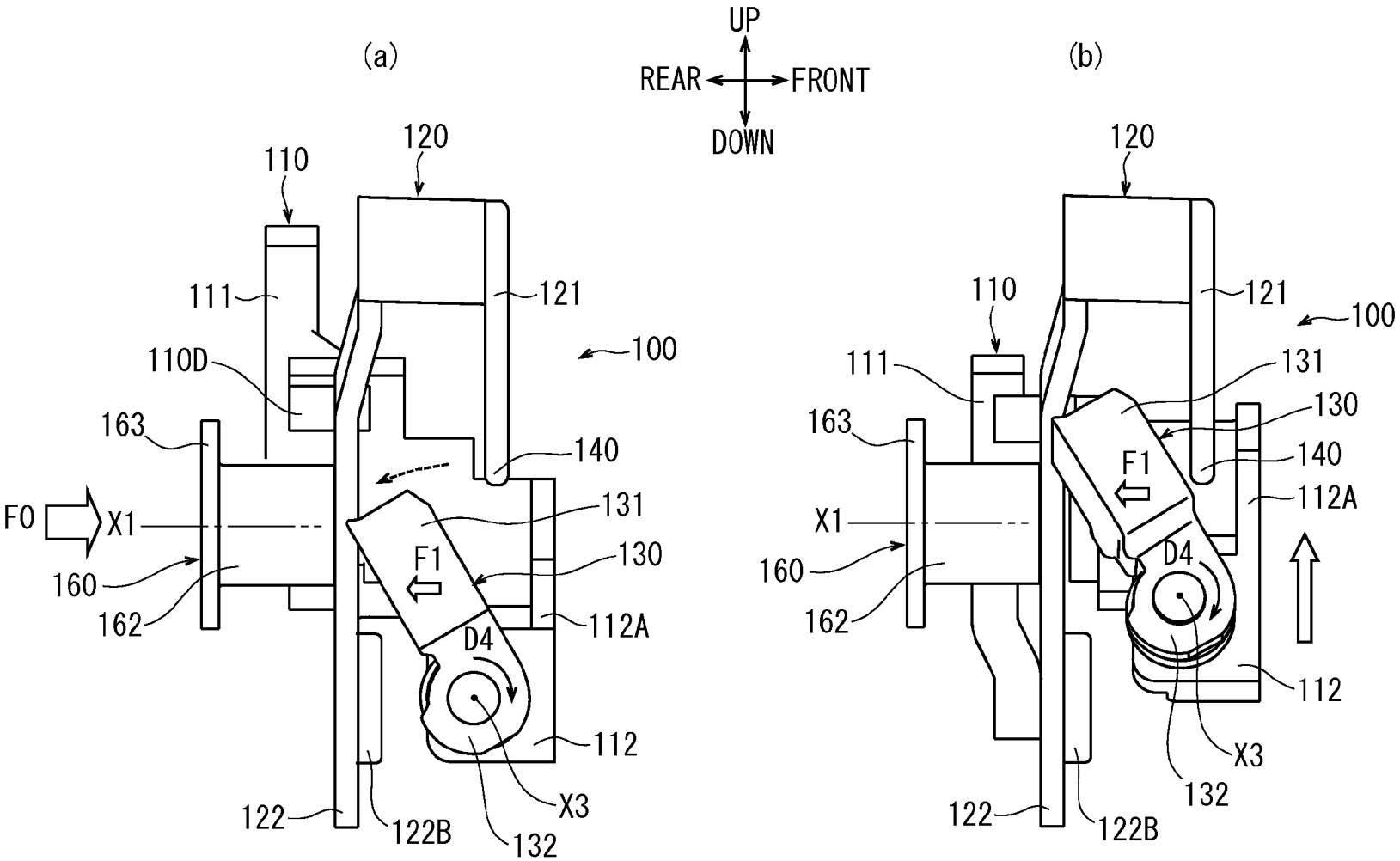
FIG. 10 relates to the vehicle door lock device of the example, in which (a) and (b) are side views for explaining a relative relationship between the inertia lever and the transmitting portion in a case in which an inertia force exceeding a preset value has acted on the inertial lever.

As illustrated in FIG. 1 and FIG. 10(*a*), the urging force of the torsion coil spring 139 and the mass of the mass member 131 are set so that, when an inertia force F1 exceeding a preset value is applied to the inertial lever 130, the inertial lever 130 pivots relative to the first lever 110 about the axis X3 from the initial position in the direction opposite to the direction D4, i.e. the inertial lever 130 pivots towards the rear of the vehicle body 9. Here, the preset value is determined as needed in accordance with an impact F0 that the tail gate 2 or the vehicle body 9 receives from the outside of the vehicle due to a collision towards the vehicle. The impact F0 acts in the direction from the rear towards the front.

As illustrated in FIG. 6 to FIG. 8, the second lever 120 includes a second input portion 121 and a second output portion 122 which are formed integrally with the axial center of pivotal movement X1 interposed therebetween.

As illustrated in FIG. 6, the second input portion 121 extends upward from the axial center of pivotal movement X1, then bends and extends rightward, and further bends and extends downward. In contrast, the second output portion 122 extends downward from the axial center of pivotal movement X1. As illustrated in FIG. 3 and FIG. 6, an elongated hole 122A elongated in the vertical direction is formed in the second output portion 122. The second output portion 122 is formed on a left end edge thereof with a guide portion 122B extending in the vertical direction and formed by bending a projecting strip. In the plan view as illustrated in FIG. 8, the second lever 120 is bent into a crank shape so that the second input portion 121 is positioned forward of the shaft hole 120H. By projecting the projecting portion 162 rearward, the second lever 120 is positioned forward of the flange portion 163.

The transmitting portion 140 is a distal end that extends downward from the second input portion 121. As illustrated in FIG. 1, FIG. 2, and FIG. 6 to FIG. 8, in the first lever 110 and the second lever 120 when not in operation, the transmitting portion 140 faces an upper surface of the inertial lever 130 at an initial position. In this state, a moderate amount of play is secured between the two.

In the normal state, i.e. in case the inertial lever 130 is at the initial position, when the first lever 110 pivots about the axial center of pivotal movement X1 in the direction opposite to the direction D3 as illustrated in FIG. 9, the mass member 131 of the inertial lever 130 is displaced upward to press the transmitting portion 140 upward. Accordingly, the transmitting portion 140 transmits the pivotal movement of the first lever 110 to the second lever 120, and the second lever 120 pivots in the direction opposite to the direction D3 about the axial center of pivotal movement X1 while opposing the urging force of the torsion coil spring 169. In addition, when the first lever 110 is restored to its original position, the second lever 120 is restored to its original position together with the first lever 110 by the torsion coil spring 169 and the prismatic column portion 110D.

As illustrated in FIG. 2, FIG. 3, FIG. 6, and FIG. 7, the movable mechanism 150 is an injection molded product formed of a thermoplastic resin, and is provided on the lower end side of the second output portion 122. The movable mechanism 150 includes the operating portion 151 formed into a substantially thick flat panel shape attached to a front surface of the second output portion 122 on the lower end side thereof, a first column portion 152 projecting rearward from the operating portion 151 in a column shape and inserted into the elongated hole 122A of the second output portion 122, a guided surface 153 formed in a left side surface of the operating portion 151 and coming into sliding contact with the guide portion 122B of the second output portion 122 as illustrated in FIG. 3 and FIG. 6, and a second column portion 154 projecting forward from the operating portion 151 in a column shape as illustrated in FIG. 7 and FIG. 11.

As illustrated in FIG. 9, by pivoting the second lever 120 about the axial center of pivotal movement X1 in the direction opposite to the direction D3, the operating portion 151 is displaced rightward so as to be capable of pressing the abutting portion 12P of the pawl 12.

Furthermore, by guiding the first column portion 152 and the guided surface 153 on the elongated hole 122A and the guide portion 122B respectively, the operating portion 151 is capable of displacing from the position illustrated in FIG. 6 and FIG. 11(*a*) to the position illustrated in FIG. 11(*b*).

As illustrated in FIG. 3, the locking and unlocking mechanism 180 includes a third lever 181 and a fourth lever 185. As illustrated in FIG. 2, the third lever 181 and the fourth lever 185 are positioned between the upright wall portion 92C and the first lever 110 and the second lever 120.

As illustrated in FIG. 3, the third lever 181 is formed into a substantially "L" shape when viewed from the rear. The fourth lever 185 is formed into a substantially fan shape when viewed from the rear.

In FIG. 11, the third lever 181 and the movable mechanism 150 are shown in an extracted manner. In FIG. 11, the operating portion 151 is positioned on the near side of the paper plane with respect to the third lever 181. However, in order to make the third lever 181 easily viewable, the operating portion 151 is illustrated with a double-dashed chain line instead of a solid line in the region that overlaps with the third lever 181. The third lever 181 is pivotably supported about a third lever pivot shaft 181S whose bent portion projects rearward from the upright wall portion 92C. The third lever 181 is formed to penetrate therethrough with a passive portion 181A positioned rightward of the third lever pivot shaft 181S and projecting forward in a column shape as illustrated in FIG. 3 and FIG. 11, and an elongated hole 181B extending in an arcuate shape in the left-right direction. As illustrated in FIG. 11, the second column portion 154 of the movable mechanism 150 extends forward from the operating portion 151 on the near side of the paper plane and is inserted into the elongated hole 181B. In order to make the relative relationship between the second column portion 154 and the elongated hole 181B easily viewable, the second column portion 154 is illustrated in a hatched cross section in FIG. 11.

As illustrated in FIG. 3, the passive portion 181A passes through an elongated hole 92E formed in the upright wall portion 92C so as to penetrate therethrough and through an opening 190A of the electric actuator 190, and projects into the electric actuator 190.

As illustrated in FIG. 2 and FIG. 3, the fourth lever 185 is pivotably supported at an intermediate portion thereof by a shaft hole 92F formed so as to penetrate through the upper portion of the upright wall portion 92C. A lower end of the fourth lever 185 is coupled to the upper end side of the third lever 181. As illustrated in FIG. 2, an upper portion of the fourth lever 185 is coupled to a rod 6. The rod 6 is coupled to a not-illustrated locking and unlocking operation lever provided on an inner surface of the tail gate 2. When the passenger operates the locking and unlocking operation lever, the action is transmitted to the third lever 181 via the rod 6 and the fourth lever 185. Accordingly, the third lever 181 is displaced from the position illustrated in FIG. 11(*a*) to the position illustrated in FIG. 11(*b*), or is displaced vice versa.

The electric actuator 190 includes a not-illustrated electric motor and a gear mechanism in the interior thereof. When the passenger performs the locking and unlocking operation using a remote control key or the like, the electric motor and the gear mechanism act on a distal end of the passive portion 181A projecting into the electric actuator 190, and the passive portion 181A is displaced in the vertical direction. Accordingly, the third lever 181 is displaced from the position illustrated in FIG. 11(*a*) to the position illustrated in FIG. 11(*b*), or is displaced vice versa.

When the rod 6 or the electric actuator 190 is activated by the locking operation by the passenger and the third lever 181 is displaced from the position illustrated in FIG. 11(*a*) to the position illustrated in FIG. 11(*b*), the elongated hole 181B and the second column portion 154 inserted into the elongated hole 181B get closer to the axial center of pivotal movement X1; accordingly, the operating portion 151 gets closer to the axial center of pivotal movement X1 as well. In this case, when the second lever 120 pivots about the axial center of pivotal movement X1 in the direction opposite to the direction D3, the second column portion 154 slides in the elongated hole 181B, and the operating portion 151 is displaced rightward in a state of being close to the axial center of pivotal movement X1 and passes above the abutting portion 12P of the pawl 12. In other words, the movable mechanism 150 disables the pawl 12 and disables switching of the fork 11 in the latched state to the unlatched state by the locking operation.

In contrast, when the rod 6 or the electric actuator 190 is activated reversely by the unlocking operation by the passenger and the third lever 181 is displaced from the position illustrated in FIG. 11(*b*) to the position illustrated in FIG.

11(*a*), the elongated hole 181B and the second column portion 154 inserted into the elongated hole 181B move away from the axial center of pivotal movement X1; accordingly, the operating portion 151 moves away from the axial center of pivotal movement X1 as well. In this case, when the second lever 120 pivots about the axial center of pivotal movement X1 in the direction opposite to the direction D3, the second column portion 154 slides in the elongated hole 181B, and the operating portion 151 is displaced rightward in a state of being away from the axial center of pivotal movement X1, and presses the abutting portion 12P of the pawl 12. In other words, the movable mechanism 150 enables the operation of the pawl 12 and enables switching of the fork 11 in the latched state to the unlatched state by the unlocking operation.

<Operational Effects>

In the door lock device 1 of the example configured as described above, the inertial lever 130 is at the initial position illustrated in FIG. 1, FIG. 2, and FIGS. 6 to 8 in the normal state. Therefore, when the first lever 110 pivots about the axial center of pivotal movement X1 in the direction opposite to the direction D3 by the opening operation of the outer door handle 8 in the normal state as illustrated in FIG. 9, the inertial lever 130 provided in the first output portion 112 of the first lever 110 and the transmitting portion 140 provided on the second input portion 121 of the second lever 120 abut against each other, and the pivotal movement of the first lever 110 is transmitted to the second lever 120. Therefore, the second lever 120 also pivots about the axial center of pivotal movement X1 in the direction opposite to the direction D3. In addition, since the operating portion 151 of the movable mechanism 150 provided on the second output portion 122 of the second lever 120 presses the abutting portion 12P of the pawl 12, the fork 11 is switched from the latched state to the unlatched state.

In this door lock device 1 as illustrated in FIG. 10(*a*), by applying an inertia force F1 that exceeds the preset value, the inertial lever 130 pivots about the axis X3 from the initial position in the direction opposite to the direction D4. In other words, when the tail gate 2 and the vehicle body 9 receive an impact F0 in the direction from the rear towards the front due to a collision or the like towards the vehicle, the inertia force F1 acts on the inertial lever 130 in the direction opposite to the direction of impact. Therefore, the inertial lever 130 pivots about the axis X3 from the initial position in the direction opposite to the direction of impact (the direction from the front towards the rear). Therefore, as illustrated in FIG. 10(*b*), due to the displacement of the outer door handle 8, the deformation of the rod 7, etc. caused by the impact F0, the first lever 110 unintentionally pivots about the axial center of pivotal movement X1 in the direction opposite to the direction D3, and even though the first output portion 112 is displaced upward, what results is a "swing-and-miss state" in which the transmitting portion 140 and the inertial lever 130, which has pivoted from the initial position due to the inertia force F1, do not abut against each other. Therefore, since the pivotal movement of the first lever 110 is not transmitted to the second lever 120, the second output portion 122 of the second lever 120 and the movable mechanism 150 avoid operating on the pawl 12, whereby the fork 11 is not switched from the latched state to the unlatched state. Consequently, an unintentional opening of the tail gate 2 at the time of impact does not occur, and hence the safety of the passenger(s) may be ensured.

In addition, in this door lock device 1, the inertial lever 130 and the transmitting portion 140 transmit or block forces between the first lever 110 and the second lever 120 which constitute the switching mechanism 100. In addition, the first axial center of pivotal movement of the first lever 110 and the second axial center of pivotal movement of the second lever 120 correspond to the coaxial axial centers of pivotal movement X1. Therefore, the positions and the lengths of the inertial lever 130 and the transmitting portion 140 are not changed irrespective of the direction of the position of the pawl 12 with respect to the axial center of pivotal movement X1, and the second lever 120 is allowed to act on the pawl 12 by setting the direction of projection of the second output portion 122 of the second lever 120 within a range from 0° to 360° about the axial center of pivotal movement X1. For example, when the abutting portion 12P of the pawl 12 is positioned within regions E1, E2 in FIG. 6, what is required is to change the direction of projection of the second output portion 122 so as to be directed toward the regions E1, E2. In this case, since the length of the inertial lever 130 need not be increased, the inertial lever 130 is unlikely to become excessively heavy. Consequently, setting of the inertia force F1 to cause the inertial lever 130 to pivot from the initial position in accordance with an impact having a desired magnitude is facilitated.

Therefore, the door lock device 1 of the example is capable of preventing the unintentional opening of the tail gate 2 at the time of impact and, simultaneously, is capable of improving the design flexibility relating to a relative positional relationship between the switching mechanism 100 and the pawl 12. Consequently, a variety of relative positional relationships among the tail gate 2, the opening 9A, the striker 99, and the outer door handle 8 can be easily accommodated, and hence a reduction in size of the door lock device 1 and an improvement of the mountability thereof with respect to the vehicle may be realized.

Also, in this door lock device 1, both of the first lever 110 and the second lever 120 are disposed with the axial center of pivotal movement X1 interposed therebetween in a balanced manner. Therefore, even when an inertia force caused by the impact F0 acts on the first lever 110 and the second lever 120, conversion of a portion of the inertia force into a rotational force that causes the first lever 110 and the second lever 120 to pivot about the axial center of pivotal movement X1 may be restrained. Consequently, realization of prevention of the opening of the tail gate 2 at the time of collision may be ensured.

Furthermore, in this door lock device 1, since the movable mechanism 150 is provided on the second output portion 122, the movable mechanism 150 can easily be brought closer to the axial center of pivotal movement X1, whereby a further reduction in size may be realized.

Also, in this door lock device 1, the first lever 110 and the second lever 120 are urged so as to be restored to their original positions by a single torsion coil spring 169 provided coaxially with the axial center of pivotal movement X1. In this configuration, in comparison with a case where urging members are provided separately on the first lever 110 and the second lever 120, the number of components may be reduced. Also, by arranging the torsion coil spring 169 coaxially with the axial center of pivotal movement X1, the space occupied by the torsion coil spring 169 may be reduced.

Furthermore, in this door lock device 1, even if an outer panel of the tail gate 2 as illustrated in FIG. 1 is smashed, the smashed outer panel 2A abuts against and is stopped by the projecting portion 162 projecting rearward from the pivotal shaft body 161, and hence spaces may be preserved between the first lever 110, the second lever 120, the inertial lever 130, and the transmitting portion 140, and the smashed outer panel 2A. Also, by bending the first lever 110 and the second lever 120 into a crank shape toward the interior of the opening 9A (that is, toward the front), the inertial lever 130 and the transmitting portion 140 are inclined toward the interior of the opening 9A. In this configuration, even when the outer panel of the tail gate 2 is smashed, a space is reliably preserved between the smashed outer panel 2A and the inertial lever 130 inclined toward the interior of the opening 9A and transmitting portion 140. Therefore, according to this door lock device 1, the probability of the occurrence of the problem that the pivotal movement of the inertial lever 130 caused by the inertia force F1 is impaired by the smashed outer panel 2A is further reduced, and hence the prevention of the opening of the tail gate 2 at the time of a collision may further be ensured.

Although the present invention has been described with reference to the example in the description described thus far, the invention is not limited to the example described above, and may be utilized by changing as needed within a range not departing the scope thereof.

Figure 12:
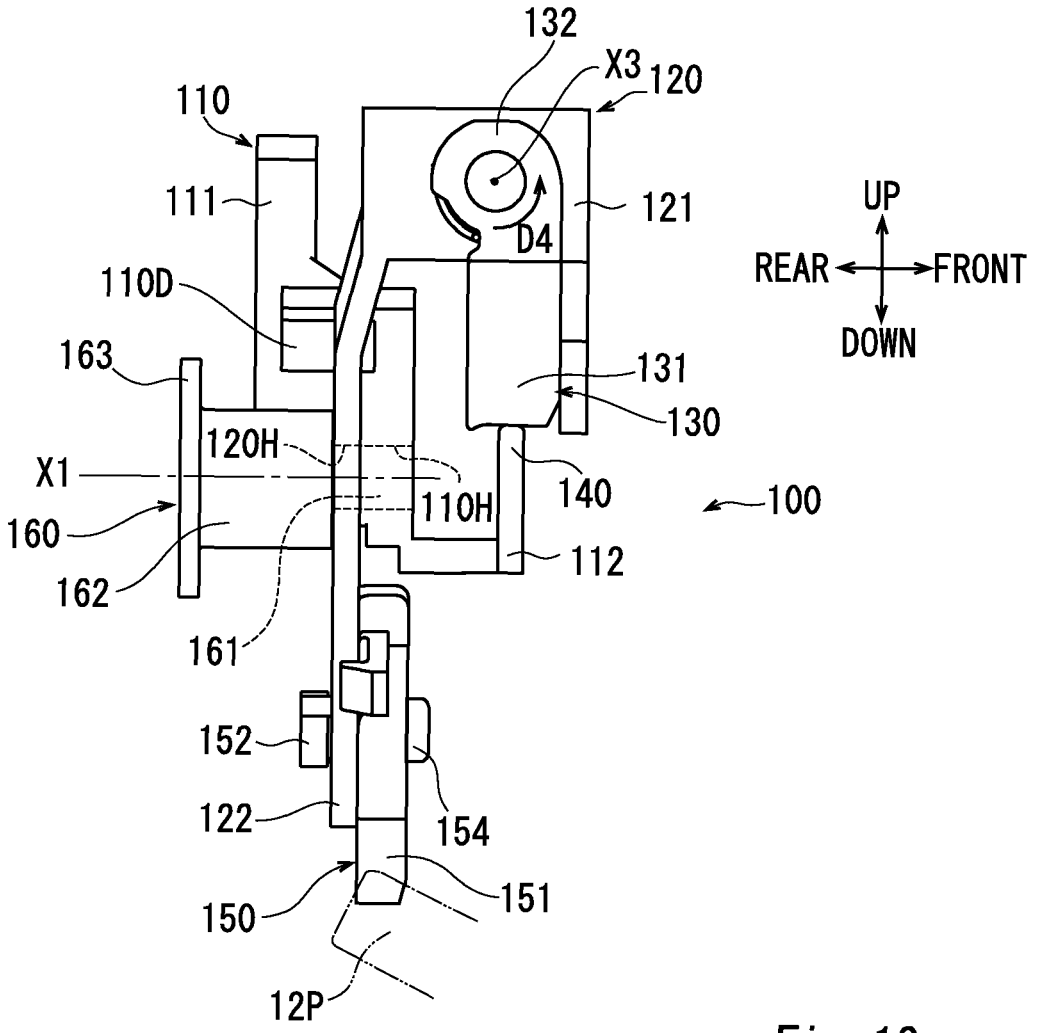
FIG. 12 shows a vehicle door lock device of a modified example of the present teachings in the same view shown in FIG. 7, wherein the inertial lever is pivotably attached to the second lever and the transmitting portion is provided on the first lever.

For example, FIG. 12 shows a vehicle door lock device of a modified example of the present teachings in the same view shown in FIG. 7, wherein the inertial lever 130 is pivotably attached to the second lever 120 and the transmitting portion 140 is provided on the first lever 110.

INDUSTRIAL APPLICABILITY

The present invention is applicable to vehicles such as automotive vehicles, buses, and industrial vehicles.

EXPLANATION OF THE REFERENCE NUMBERS

9 . . . vehicle body
9A . . . opening
2 . . . door (tail gate)
99 . . . striker
98 . . . entry opening
90 . . . mounting member
11 . . . fork
12 . . . pawl
100 . . . switching mechanism
1 . . . vehicle door lock device
8 . . . outer door handle
X1 . . . axial center of pivotal movement (first axial center of pivotal movement, second axial center of pivotal movement)
110 . . . first lever
120 . . . second lever
X3 . . . axis
F1 . . . inertia force
130 . . . inertial lever
140 . . . transmitting portion
111 . . . first input portion
112 . . . first output portion
121 . . . second input portion
122 . . . second output portion
150 . . . movable mechanism
169 . . . torsion coil spring
161 . . . pivot shaft body
162 . . . projecting portion

The invention claimed is:

1. A vehicle door lock comprising:

a mounting member configured to be provided on a door that opens and closes an opening of a vehicle body and having an entry opening, into which a striker fixed to the vehicle body is insertable;

a fork pivotably provided on the mounting member and configured to switch between a latched state, in which the striker is lockable within the entry opening, and an unlatched state, in which the striker is free to be removed from the entry opening;

a pawl pivotably provided on the mounting member and configured to selectively fix and permit pivotal movement of the fork; and a switching mechanism provided on the mounting member and configured to act on the pawl to switch the fork from the latched state to the unlatched state, wherein the switching mechanism includes:

a first lever configured to be operatively coupled to an outer door handle and/or to an inner door handle, the first lever being pivotable about a first axial center of pivotal movement in response to an opening operation of the outer door handle or the inner door handle;

a second lever having a member at an end portion of the second lever configured to transmit movement from the second lever to the pawl when the second lever pivots about a second axial center of pivotal movement;

an inertial lever provided on one of the first lever and the second lever, the inertial lever being pivotable about an axis extending in a direction orthogonal to the direction of advance and retraction with respect to the vehicle opening, and being pivotable away from an initial position about the axis when an inertia force exceeding a preset value is applied thereto; and a transmitting portion provided on the other one of the first lever and the second lever, the transmitting portion being configured to transmit the pivotal movement of the first lever to the second lever by abutting against the inertial lever when the inertial lever is disposed at the initial position and, being further configured to not transmit the pivotal movement of the first lever to the second lever by not abutting against the inertial lever when the inertial lever has pivoted away from the initial position, and the first axial center of pivotal movement and the second axial center of pivotal movement are coaxial axial centers of pivotal movement.

2. The vehicle door lock according to claim 1, wherein:

the first lever includes a first input portion configured to be coupled to the outer door handle and/or to the inner door handle, and a first output portion integrated with the first input portion, the axial centers of pivotal movement being interposed between the first input portion and the first output portion, the second lever includes a second input portion and a second output portion integrated with the second input portion, the axial centers of pivotal movement being interposed between the second input portion and the second output portion, and the second output portion being configured to act on the pawl via the member, the inertial lever is provided on one of the first output portion and the second input portion, and the transmitting portion is provided on the other one of the first output portion and the second input portion.

3. The vehicle door lock according to claim 2, wherein the member is a movable mechanism provided on the second output portion or wherein the vehicle door lock further comprises a movable mechanism provided on the pawl, the movable mechanism being configured to disable the pawl by performing a locking operation which prevents the fork in the latched state from being switched to the unlatched state and, being further configured to enable the pawl by performing an unlocking operation which allows the fork in the latched state to be switched to the unlatched state.

4. The vehicle door lock according to claim 3, further comprising a single torsion coil spring provided coaxially with the first and second axial centers of pivotal movement, the single torsion coil urging the first lever and the second lever towards their respective original positions.

5. The vehicle door lock according to claim 4, further comprising a pivot shaft having an axial center that is coaxial with the first and second axial centers of pivotal movement, wherein the pivot shaft includes:

a pivot shaft body that supports the first lever and the second lever and a projecting portion that projects from the pivot shaft body toward the outside of the vehicle body opening.

6. The vehicle door lock according to claim 5, wherein the first lever and the second lever are bent into a crank shape toward an interior of the vehicle body opening, such that the inertial lever and the transmitting portion are inclined toward the interior of the vehicle body opening.

7. The vehicle door lock according to claim 1, wherein the member is a movable mechanism provided at the end portion of the second lever or wherein the vehicle door lock further comprises a movable mechanism provided on the pawl, the movable mechanism being configured to selectively:

disable the pawl to prevent the fork from being switched to the unlatched state when the fork is in the latched state and enable the pawl to allow the fork to be switched from the latched state to the unlatched state.

8. The vehicle door lock according claim 1, further comprising a single torsion coil spring disposed coaxially with the first and second axial centers of pivotal movement, the single torsion coil urging the first lever and the second lever towards their respective original positions.

9. The vehicle door lock according to claim 1, further comprising a pivot shaft having an axial center that is coaxial with the first and second axial centers of pivotal movement, wherein the pivot shaft includes:

a pivot shaft body that supports the first lever and the second lever and a projecting portion that projects from the pivot shaft body towards the outside of the vehicle body opening.

10. The vehicle door lock according to claim 1, wherein the first lever and the second lever are bent into a crank shape toward an interior of the vehicle body, such that the inertial lever and the transmitting portion are inclined toward the interior of the vehicle body.

11. A vehicle door lock comprising:

a mounting member configured to be provided on a door that opens and closes an opening of a vehicle body, the mounting member having an entry opening configured to receive a striker fixed to the vehicle body;

a fork pivotably disposed on the mounting member and configured to switch between a latched state, in which the striker is lockable within the entry opening, and an unlatched state, in which the striker is free to be removed from the opening;

a pawl pivotably disposed on the mounting member and configured to selectively fix and permit pivotal movement of the fork;

a first lever configured to be operatively coupled to an outer door handle and/or to an inner door handle, the first lever being pivotable about a first axial center of pivotal movement in response to actuation of the outer door handle or the inner door handle;

a second lever having a member at an end portion of the second lever configured to transmit movement from the second lever to the pawl to switch the fork from the latched state to the unlatched state when the second lever pivots about a second axial center of pivotal movement; and an inertial lever disposed on one of the first lever and the second lever, the inertial lever being pivotable about an axis, which extends at least substantially parallel to the door, away from an initial position when an inertia force exceeding a predetermined value acts on the inertial lever in a direction at least substantially perpendicular to the door;

wherein the first lever, the second lever and the inertial lever are further configured such that, when the inertial lever is disposed in its initial position, pivotal movement of the first lever is transmitted to the second lever, and when the inertial lever has been pivoted away from its initial position, pivotal movement of the first lever is not transmitted to the second lever, and wherein the first axial center of pivotal movement is coaxial with the second axial center of pivotal movement.

12. The vehicle door lock according to claim 11, wherein:

the first lever includes a first input portion configured to be coupled to the outer door handle and/or to the inner door handle, and a first output portion integrated with the first input portion, the first and second axial centers of pivotal movement being interposed between the first input portion and the first output portion, the second lever includes a second input portion and a second output portion integrated with the second input portion, the first and second axial centers of pivotal movement being interposed between the second input portion and the second output portion, and the second output portion being configured to act on the pawl via the member, and the inertial lever is provided the first output portion or the second input portion.

13. The vehicle door lock according to claim 12, wherein the member is a movable mechanism provided on the second output portion or wherein the vehicle door lock further comprises a movable mechanism provided on the pawl, the movable mechanism being configured to selectively:

disable the pawl to prevent the fork from being switched to the unlatched state when the fork is in the latched state and enable the pawl to allow the fork to be switched from the latched state to the unlatched state.

14. The vehicle door lock according claim 13, further comprising a single torsion coil spring disposed coaxially with the first and second axial centers of pivotal movement, the single torsion coil urging the first lever and the second lever towards their respective original positions.

15. The vehicle door lock according to claim 14, further comprising a pivot shaft having an axial center that is coaxial with the first and second axial centers of pivotal movement, wherein the pivot shaft includes:

a pivot shaft body that supports the first lever and the second lever and a projecting portion that projects from the pivot shaft body in a direction towards an exterior of the vehicle body.

16. The vehicle door lock according to claim 15, wherein the first lever and the second lever are bent into a crank shape such that the inertial lever is disposed farther towards an interior of the vehicle body than the projecting portion.

17. The vehicle door lock according to claim 11, wherein the member is a movable mechanism provided at the end portion of the second lever or wherein the vehicle door lock further comprising a movable mechanism provided on the pawl, the movable mechanism being configured to selectively:

disable the pawl to prevent the fork from being switched to the unlatched state when the fork is in the latched state and enable the pawl to allow the fork to be switched from the latched state to the unlatched state.

18. The vehicle door lock according claim 11, further comprising a single torsion coil spring disposed coaxially with the first and second axial centers of pivotal movement, the single torsion coil urging the first lever and the second lever towards their respective original positions.

19. The vehicle door lock according to claim 11, further comprising a pivot shaft having an axial center that is coaxial with the first and second axial centers of pivotal movement, wherein the pivot shaft includes:

a pivot shaft body that supports the first lever and the second lever and a projecting portion that projects from the pivot shaft body in a direction towards an exterior of the vehicle body.

20. The vehicle door lock according to claim 19, wherein the first lever and the second lever are bent into a crank shape such that the inertial lever is disposed farther towards an interior of the vehicle body than the projecting portion.

* * * * *